US008919433B2

(12) United States Patent
O'Malley

(10) Patent No.: US 8,919,433 B2
(45) Date of Patent: Dec. 30, 2014

(54) RESILIENT FOAM DEBRIS BARRIER

(75) Inventor: Edward J. O'Malley, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 379 days.

(21) Appl. No.: 12/687,701

(22) Filed: Jan. 14, 2010

(65) Prior Publication Data

US 2011/0168387 A1 Jul. 14, 2011

(51) Int. Cl.

| | |
|---|---|
| ***E21B 37/00*** | (2006.01) |
| ***E21B 34/06*** | (2006.01) |
| ***E21B 41/00*** | (2006.01) |
| ***E21B 33/12*** | (2006.01) |

(52) U.S. Cl.

CPC ..... *E21B 41/00* (2013.01); *E21B 34/06* (2013.01); *E21B 33/12* (2013.01)

USPC ..... 166/173

(58) Field of Classification Search

USPC ..... 166/56, 236, 173, 174, 311, 235, 229, 166/278, 382, 207, 242.2, 384, 387

See application file for complete search history.

(56) References Cited

U.S. PATENT DOCUMENTS

| | | | | |
|---|---|---|---|---|
| 2,302,116 | A * | 11/1942 | Gill | 210/131 |
| 2,837,032 | A * | 6/1958 | Horsting, Sr. | 92/78 |
| 2,891,623 | A | 6/1959 | Boss | |
| 2,981,331 | A * | 4/1961 | Arterbury | 166/250.08 |
| 3,515,210 | A * | 6/1970 | Perkins | 166/205 |
| 3,584,684 | A | 6/1971 | Anderson et al. | |
| 3,993,136 | A | 11/1976 | Mott | |
| 5,316,677 | A * | 5/1994 | Harms, II | 210/455 |
| 5,422,380 | A * | 6/1995 | Mendelsohn et al. | 521/107 |
| 5,551,513 | A * | 9/1996 | Surles et al. | 166/278 |
| 6,112,811 | A * | 9/2000 | Kilgore et al. | 166/134 |
| 6,206,328 | B1 | 3/2001 | Taylor | |

(Continued)

FOREIGN PATENT DOCUMENTS

| | | |
|---|---|---|
| WO | 2008079777 A2 | 7/2008 |
| WO | 2009045656 A1 | 4/2009 |

OTHER PUBLICATIONS

Li, J., et al., "Sand/Well Vacuuming Technology wiht Concentric Coiled Tubing: Best Practices and Lessons Learned from Over 600 Operations", SPE 115303, Oct. 2008, 1-23.

(Continued)

*Primary Examiner* — David Andrews
*Assistant Examiner* — Ronald Runyan
(74) *Attorney, Agent, or Firm* — Steve Rosenblatt

(57) ABSTRACT

A space filler material is used to prevent accumulation of debris that could later foul the operation of adjacent moving parts. In one application a void space that is subsequently closed by actuated parts is initially filled with a material that is highly compressible and has voids that allow it to compress without undue resistance to part movement when the void volume is reduced. Ideally, the pores or voids in the material itself are small enough to keep most if not all the debris from entering and making the space filling material too rigid to collapse under part movement. In an alternative application, the material can be in an annular space such as a seal bore and it can keep debris from getting past the seal bore while allowing hydrostatic pressure across itself thereby helping it to maintain its position until moved such as by shifting of an inner string to which it is attached.

6 Claims, 3 Drawing Sheets

(56) References Cited

U.S. PATENT DOCUMENTS

| | | | | |
|---|---|---|---|---|
| 6,766,862 | B2 * | 7/2004 | Chatterji et al. | 166/381 |
| 7,172,027 | B2 * | 2/2007 | Simpson et al. | 166/382 |
| 7,216,706 | B2 | 5/2007 | Echols et al. | |
| 7,552,777 | B2 | 6/2009 | Murray et al. | |
| 7,673,688 | B1 * | 3/2010 | Jones et al. | 166/311 |
| 2005/0103493 | A1 | 5/2005 | Stevens et al. | |
| 2005/0159292 | A1 * | 7/2005 | Pham et al. | 501/80 |
| 2005/0217854 | A1 | 10/2005 | Hayes et al. | |
| 2007/0144731 | A1 | 6/2007 | Murray et al. | |
| 2007/0240877 | A1 | 10/2007 | O'Malley et al. | |
| 2008/0087431 | A1 | 4/2008 | Willauer et al. | |
| 2008/0099206 | A1 * | 5/2008 | van Batenburg et al. | 166/305.1 |
| 2008/0145591 | A1 | 6/2008 | Elbert et al. | |
| 2008/0264647 | A1 | 10/2008 | Li | |
| 2008/0296023 | A1 | 12/2008 | Willauer | |
| 2012/0125631 | A1 * | 5/2012 | Entchev et al. | 166/376 |

OTHER PUBLICATIONS

Curtis, James, et al, "Improving Wellbore and Formation Cleaning Efficiencies with Environmental Solvents and Pickling Solutions", SPE 81138, Apr. 2003, 1-11.

Li, J., et al., "Sand Cleanout with Coiled Tubing: Choice of Process, Tools, or Fluids?", SPE 113267, Jun. 2008, 1-27.

* cited by examiner

RESILIENT FOAM DEBRIS BARRIER

FIELD OF THE INVENTION

The field of this invention is a space filling material that can keep debris out of internal open spaces in subterranean tools that can otherwise fill with debris and more particularly annular spaces such as below seal bores or spaces that allow for movement of components.

BACKGROUND OF THE INVENTION

Dense foams have been used as sealing elements in packers where they are called on to withstand pressure differentials while sealing off one zone in a borehole from another. U.S. Pat. No. 7,216,706 shows in FIG. 26 a foam sleeve used as a packer over a tubular that is expanded as described in columns 19 and 20. US 2005/0103493 FIGS. 4 and 5 illustrate a plug with a foam exterior that can get around obstructions before landing, see paragraph 41.

In other applications foam can be pumped into a borehole to bring with it to the surface the debris that is encountered when the foam is released. US 2005/0217854 shows circulating foam to remove debris, see FIG. 2*a* and paragraphs 37-39.

In yet other applications unrelated to subterranean operations, foam can be used as a structural material such as in a roll assembly or to protect space vehicles from flying debris. US 2008/0145591 shows a roll with foam core. U.S. Pat. No. 6,206,328 uses foams as an external barrier from flying objects that can strike a space vessel.

None of these uses of foam address the present invention. There are numerous situations where movable components in tools used in subterranean locations are in debris-laden environments and there are movable parts that create an open void space when in one position and move to reduce the volume of that void space when actuated into another position. In some applications there can be a long time between such movements and during that time the debris that comes off tubing walls or is carried in the drilling mud or by cuttings generated from milling or drilling and during that time such debris can get into such voids so that when it is time to actuate the tool component it will not move fully or at all because of a buildup of debris. The component could also jam on the debris after moving just a part of its needed range of motion. In other applications, notably in gravel packing where there are seal bores that are potential collection locations for debris and the gravel has to make a lateral exit when deposited it is advantageous to keep the gravel or proppant out of not only the seal bores but also from the locations that are below. At the same time it would also be significant to allow hydrostatic pressure to be communicated through such a debris barrier so that pressure differentials do not tear it out of its position. In such applications the foam annular cylindrical shape can be used around an inner string for positioning in a gravel packing bottom hole assembly so that the delivered debris stays out of locations where it can collect and affect the operation of downhole equipment. In such applications, the foam shape would not be significantly compressed. In other applications where the foam is inserted into a void whose volume needs to be reduced when parts are actuated to move, there is a need for the foam or other selected material to be able to compress to accommodate part movement. While some infiltration of the void space is envisioned the mass of the foam or other material still needs to be able to compress enough to allow part movement of the surrounding tool.

Those skilled in the art will more readily appreciate other aspects of the invention from a review of the detailed description of the preferred embodiment and the associated drawings while recognizing that the full scope of the invention is to be found in the appended claims.

SUMMARY OF THE INVENTION

A space filler material is used to prevent accumulation of debris that could later foul the operation of adjacent moving parts. In one application a void space that is subsequently closed by actuated parts is initially filled with a material that is highly compressible and has voids that allow it to compress without undue resistance to part movement when the void volume is reduced. Ideally, the pores or voids in the material itself are small enough to keep most if not all the debris from entering and making the space filling material too rigid to collapse under part movement. In an alternative application, the material can be in an annular space such as a seal bore and it can keep debris from getting past the seal bore while allowing hydrostatic pressure across itself thereby helping it to maintain its position until moved such as by shifting of an inner string to which it is attached.

DETAILED DESCRIPTION OF THE PREFERRED EMBODIMENT

Figure 2:
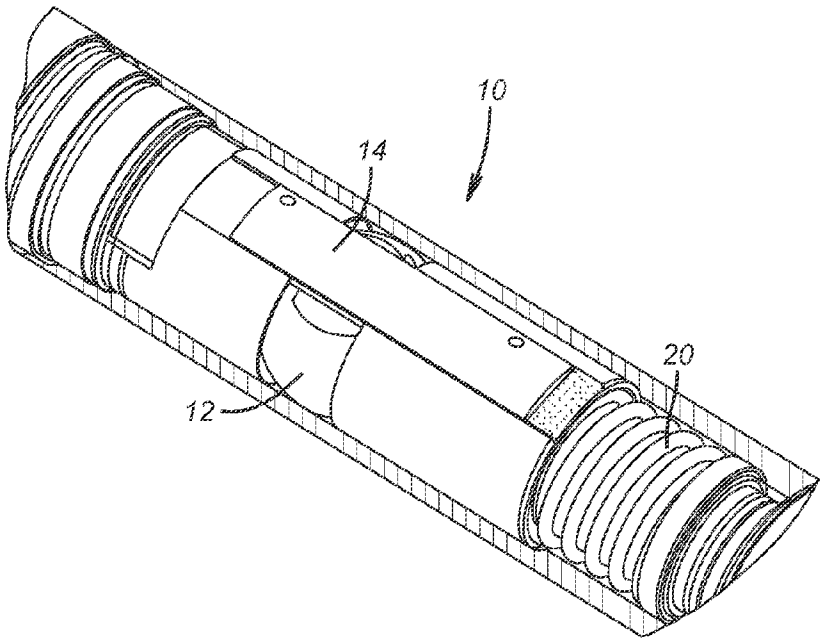
FIG. 2 is the view of FIG. 1 with the valve in the open position.
Figure 1:
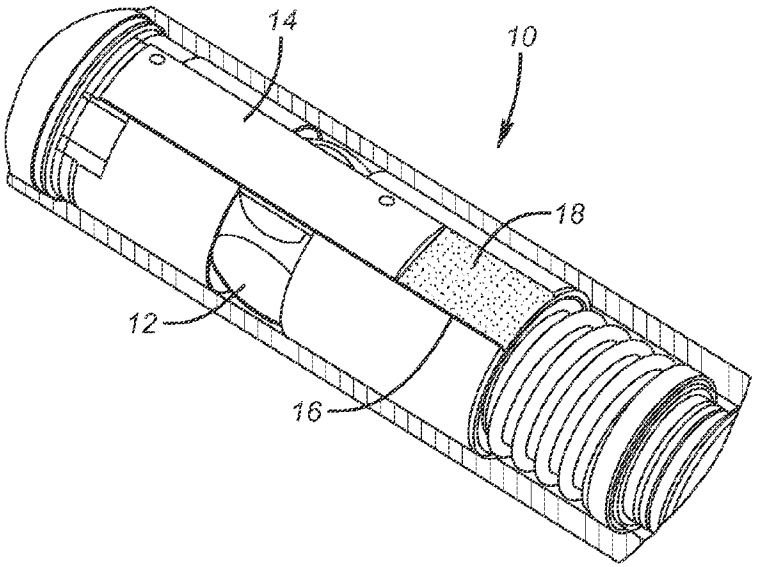
FIG. 1 is a perspective view of an application for a ball valve operator with the valve in the closed position.

FIGS. 1 and 2 are a schematic representation of a ball valve assembly 10 that shows in FIG. 1 the ball 12 in the closed position. The operator 14 is retracted toward the left end of the FIG. 1 leaving a void space 16 which is filled with a filler material 18. A return spring 20 is compressed when the operator 14 is shifted to the right as shown in FIG. 2. The void space 16 is exposed to well fluids and can after time fill with solid debris. The accumulation of debris in the void space 16 can impair the movement of the operator 14 and prevent the valve from fully opening or subsequently closing.

The concept is to substantially or entirely fill the void space 16 with a material that has several properties. It needs to easily change its volume so that adjacent moving parts can be functioned with minimal resistance. To do so, one way is to have a pore structure so that mechanical compression results in the desired volume reduction by collapse of such pores. In the preferred embodiment, the pore size is at or smaller than the anticipated debris size so that the debris does not materially infiltrate the pores and subsequently make volume reduction in response to an applied force from a moving part such as operator 14, harder to accomplish. In another aspect of the preferred embodiment the network of pores in the structure of the fill material 18 allow fluid migration therethrough so that in some applications, such as in FIGS. 5 (where the filler material is 34) and 6 hydrostatic pressure transmission across the fill material 18 can be communicated.

Open cell foam can be one material that serves the desired function by having compatible physical characteristics. Other materials can be used that have one or more of these desired performance characteristics.

Figure 3:
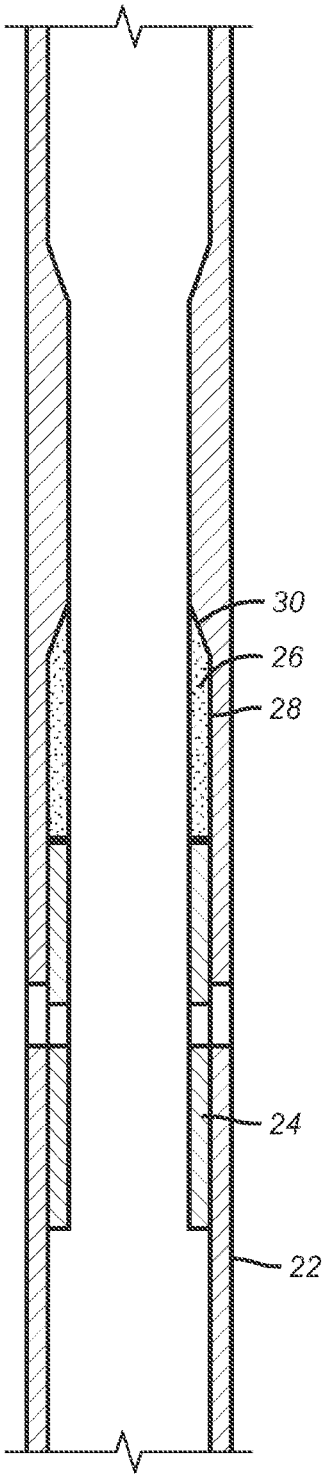
FIG. 3 is a section view of a sliding sleeve application with the sleeve in the open position.
Figure 4:
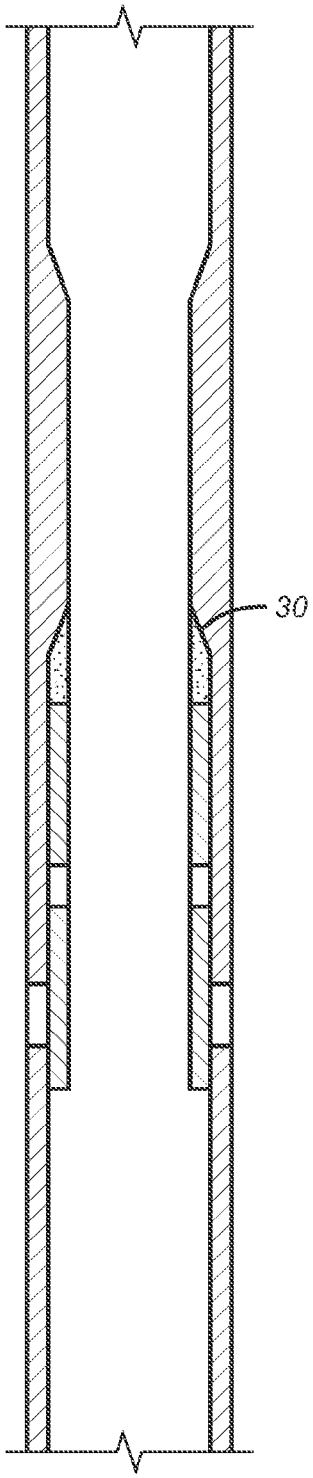
FIG. 4 is the view of FIG. 3 with the sliding sleeve in the closed position.

FIGS. 3 and 4 illustrate another application where a tubular 22 has a sliding sleeve 24 that is shown in the open position in FIG. 3. A cylindrically shaped sleeve of filler material 26 fills the recess 28 that has its largest volume in the FIG. 3 position. In the FIG. 4 position the sleeve 24 has been shifted by a tool (not shown) so that the filler material 26 has had its volume reduced. It should be noted that the material 26 can be resilient enough to allow the use of taper 30 by the shifting tool (not shown) so as to release from the sleeve 24 in a manner well known in the art. Optionally the filler material 26 does not need to be a complete cylinder but can alternatively be in a series of strips or rings or other shapes parallel to each other. Stated differently, the entire void volume does not need to be filled. If the filler material can have its volume easily reduced then ideally its initial volume should be the volume represented by the stroke of the part that is adjacent when the part moves.

Those skilled in the art will appreciate that if an adhesive or other retainer is used to hold the filler material in position in any application of the present invention, the adhesive or retainer has to be administered or positioned so that volume reduction and expansion can take place responsive to part movement. For example the adhesive can be applied to a fixed supported end leaving an opposite end flexible for compression and subsequent expansion when the adjacent part is moved.

The filler material can have shape memory so that it can be of an initial smaller volume when installed in position adjacent a moving part and then well fluid temperature can cause it to grow to more fully fill the void space where it is originally placed. Using a shape memory foam or polymer will also give an added advantage of retaining a force when compressed so that when the adjacent part reverses its movement direction the filler material will have the stored energy on tap to aid in gaining volume to fill the newly created space from movement of the adjacent component.

Figure 5:
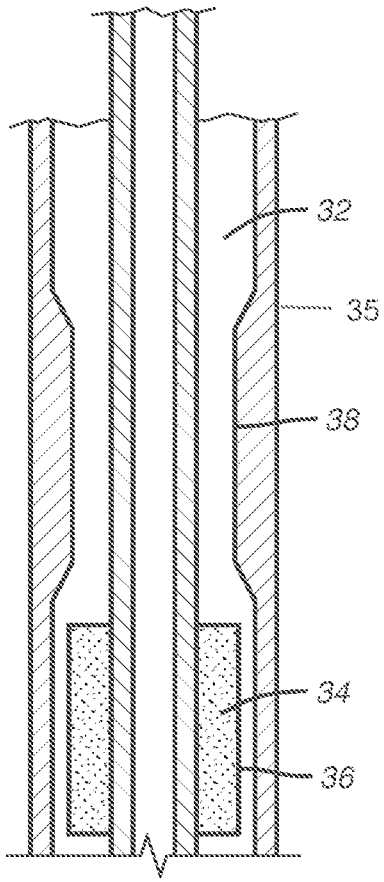
FIG. 5 is a view of an annular debris barrier in a first position on an inner string where the barrier is out of the seal bore.
Figure 6:
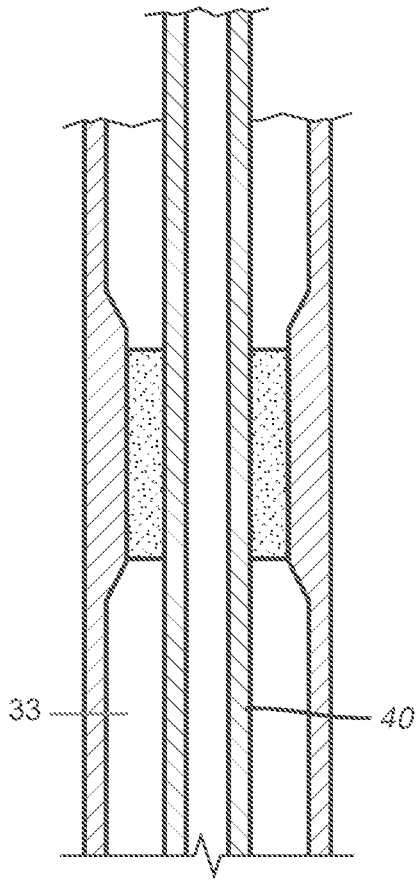
FIG. 6 is the view of FIG. 5 with the inner string shifted to position the barrier in the seal bore.

Other applications are envisioned as illustrated in FIGS. 5 and 6. In this application a first annular zone 32 in a surrounding tubular 35 needs a debris barrier 34 that can not only at a select time stop the progress of debris or proppant but at the same time also allow hydrostatic pressure to be communicated through the barrier 34. To minimize the needed outside diameter 36 when barrier is placed into operating position as in FIG. 6 the barrier 34, representing an inner member, is designed to fit into a seal bore 38 when in the needed operating position of FIG. 6 separating first zone 32 from second annular zone 33. At other times, as in FIG. 5, the barrier 34 is offset from the seal bore 38 to allow flow and pressure to be communicated around it without getting in the way. In these two FIGS. the application is in a gravel packing assembly where it is desired to prevent the gravel or proppant from going down into the lower reaches of the annular space 32 and fouling the operation of equipment located there such as other seal bores or mechanical devices. This is a concern when depositing the gravel around screens (not shown) and where return fluid passes back uphole through the wash pipe 40 to go to an upper annulus above a set packer.

In this application the debris barrier prevents passage of debris in an annular space. It need not be longitudinally compressed as in the embodiments of FIGS. 1-4. The pore structure allows it to transmit hydrostatic pressure while the pore sizes limit if not eliminate the migration of solids into the structure of barrier 34. In this application since there is no longitudinal compression, migration of solids into the structure of the barrier 34 is less important. Optimally the solids or debris do not fully migrate to the opposite end from where they entered.

Those skilled in the art will appreciate that the system ensures the reliability of moving parts whose movement could become impaired with debris buildup over time in various nooks and crannies that define a volume that a moving part in one of its positions will need to occupy. While offering a wide choice of materials depending on the nature of well fluids and operating temperatures, the benefits are longer term reliable operation by reducing the size of such debris accumulation locations while not adding significant resistance to part movement when compressing the debris barrier. The compressed barrier has stored potential energy to spring back when the adjacent part moves in an opposite direction. The preferred pore structure reduces or eliminates debris infiltration while still allowing the barrier to compress without undue resistance. In an alternative embodiment an annular space is protected from advancing debris from a barrier that still allows hydrostatic pressure through itself. In this environment, the annularly shaped barrier is moved into a position where it spans the annular space such as by shifting of a work string to which it is attached. While the barrier can be radially compressed when this happens, there is no need for material axial compression in this embodiment. While a foam is preferred, resilient porous materials that can be compressed without material resistance and in some applications communicate hydrostatic pressure through themselves are also possible candidates. Shape memory polymers or foams are also a viable candidate.

The above description is illustrative of the preferred embodiment and many modifications may be made by those skilled in the art without departing from the invention whose scope is to be determined from the literal and equivalent scope of the claims below.

I claim:

1. An annular volume debris barrier at a subterranean location, comprising:

a movable inner member extending through a barrier zone of surrounding tubular to define an annular volume therebetween, said barrier zone defined by a reduced diameter length inside said surrounding tubular;

a porous foam debris barrier selectively supported in said barrier zone and mounted on said inner member and having an initial external radial dimension at least as large as said barrier zone that makes selective contact with the surrounding tubular at said barrier zone by virtue of axial movement of said debris barrier into alignment with said barrier zone to retain debris in said annular volume in a first annular zone defined on one side of said debris barrier when said debris barrier is selectively relatively axially moved by tandem movement with said inner member with respect to said surrounding tubular and into contact with said surrounding tubular in said barrier zone while said surrounding tubular is disposed at the subterranean location, while allowing hydrostatic fluid pressure to act through said debris barrier to reach a second annular zone defined on an opposite axial end of said debris barrier when said debris barrier is selectively in contact with said barrier zone of said surrounding tubular;

said debris barrier selectively placed out of contact with said surrounding tubular leaving an open flow path between said first and second annular zones.

2. The barrier of claim 1, wherein:

said outer tubular has a reduced diameter seal bore;

said debris barrier selectively contacting said seal bore on movement of said inner member.

3. The barrier of claim 2, wherein:

said sleeve is radially compressed when inserted into said seal bore.

4. The barrier of claim 1, wherein:

said outer tubular has a reduced diameter seal bore;

said debris barrier selectively contacting said seal bore on movement of said inner member;

said debris barrier comprises an annular sleeve.

5. The barrier of claim 1, wherein:

said debris barrier has pores;

some of said pores are smaller than the debris thereby excluding the debris from entering said pores.

6. The barrier of claim 1, wherein:

said debris barrier comprises shape memory foam or a shape memory polymer.

* * * * *